United States Patent [19]

Morel et al.

[11] 4,200,513

[45] Apr. 29, 1980

[54] DEVICE FOR REDUCING MAGNETIC DISTURBANCES IN SERIES OF VERY HIGH INTENSITY ELECTROLYSIS CELLS

[75] Inventors: Paul Morel, Le Vesinet; Jean-Pierre Dugois, Saint-Jean-de-Maurienne, both of France

[73] Assignee: Aluminum Pechiney, Lyons, France

[21] Appl. No.: 928,607

[22] Filed: Jul. 27, 1978

[30] Foreign Application Priority Data

May 29, 1978 [FR] France ..... 78 16808

[51] Int. Cl.[2] ..... C25C 3/16; C25C 3/06

[52] U.S. Cl. ..... 204/243 M; 204/244; 204/279

[58] Field of Search ..... 204/243 M, 244, 67, 204/245-247, 279

[56] References Cited

U.S. PATENT DOCUMENTS 4,049,528 9/1977 Morel et al. ..... 204/243 M 4,072,597 2/1978 Morel et al. ..... 204/243 M

FOREIGN PATENT DOCUMENTS 434135 10/1974 U.S.S.R. ..... 204/244

458616 2/1975 U.S.S.R. ..... 204/243 M

*Primary Examiner*—John H. Mack

*Assistant Examiner*—D. R. Valentine

*Attorney, Agent, or Firm*—Dennison, Dennison, Meserole & Pollack

[57] ABSTRACT

The invention relates to a device for reducing magnetic disturbances in a series of very high intensity electrolysis cells. The device is characterized by the supply of an anode bus bar both through its two ends and through at least one central riser supplied from upstream cathode outputs and by a branch on the downstream cathode output rods of the preceding cell. Application is to the production of aluminum by electrolysis of alumina in molten cryolite.

2 Claims, 9 Drawing Figures

DEVICE FOR REDUCING MAGNETIC DISTURBANCES IN SERIES OF VERY HIGH INTENSITY ELECTROLYSIS CELLS

SUBJECT OF THE INVENTION

The present invention relates to a new device for reducing magnetic disturbances in series of transverse, very high intensity, electrolysis cells intended for the production of aluminum by electrolysis of alumina dissolved in molten cryolite. It is applied to the reduction of the disturbances caused by the actual field created by each cell and by its neighbors in the same line. The influence of one or more adjoining lines, when these lines are located relatively close to the line under consideration, forms the subject of a separate patent application, filed July 18, 1978, Ser. No. 925,849.

It is known that in order to reduce investments and increase profits in the aluminum industry, there is a tendency to increase the power of the cells which were supplied at 100,000 amperes twenty years ago but now attain 200,000 amperes. It is also known that the cells arranged in a transverse direction to the axis of the line have, with equal dimensions, lesser magnetic effects than the cells arranged in a longitudinal direction, despite the complication in the resulting operating conditions.

In the following, the usual conventions will be adopted and the components of the magnetic field along the Ox, Oy and Oz axes will be designated by Bx, By and Bz, and, in a direct right-angled trihedron whose center O is the center of the cathode plane of the cell, Ox is the longitudinal axis in the direction of the line, Oy is the transverse axis and Oz is the vertical axis directed upwards.

According to the usual convention, the upstream and downstream positions will be designated by reference to the conventional direction of the current in the series.

With respect to the graphs of the magnetic fields, the term "antisymmetrical" about a given plane will refer to a function when two equal values having a sign opposite to the function correspond to any couple of points which are symmetrical about this plane.

IN THE DRAWINGS

FIG. 1 shows diagrammatically, in a transverse vertical partial section passing through the point O defined above, an electrolysis cell arranged in a transverse direction to the axis of the series. The Ox axis is therefore perpendicular to the plane of the figure. The half-section on the left shows the vectors of the magnetic fields induced by the central risers and the lateral connections. The half-section on the right shows the overcrowding of the anode system of half-length a. The half-width b appears in FIG. 2.

FIGS. 1 to 4 are illustrative and are intended to simplify the statement of the problem.

FIGS. 5 to 9 relate to the actual invention herein.

STATEMENT OF THE PROBLEM

U.S. Pat. No. 4,049,528 granted on Sept. 20, 1977 to Aluminium Pechiney set forth conditions to be respected for reducing the magnetic effects in transverse cells, and experimentation has shown that the application of these conditions for this type of cell brought substantial progress in the production of aluminum, particularly with respect to consumption of energy.

However, this theory did not take into consideration the screen effect produced by the ferro-magnetic masses essentially formed by the shell, the super-structure, the cathode rods and possibly the building.

Development of a method of measuring the cells during operation in the center of the bath and of the cathode metal allowed the influence of these ferro-magnetic masses on the fields determined by calculation to be determined.

We will call the discrepancy between the measured fields and calculated fields "field of magnetization". It is variable at all points of the cathode and experience shows that it is at a maximum in the ends of the cell and that it decreases as it shifts toward the center where it is zero.

Figure 1:
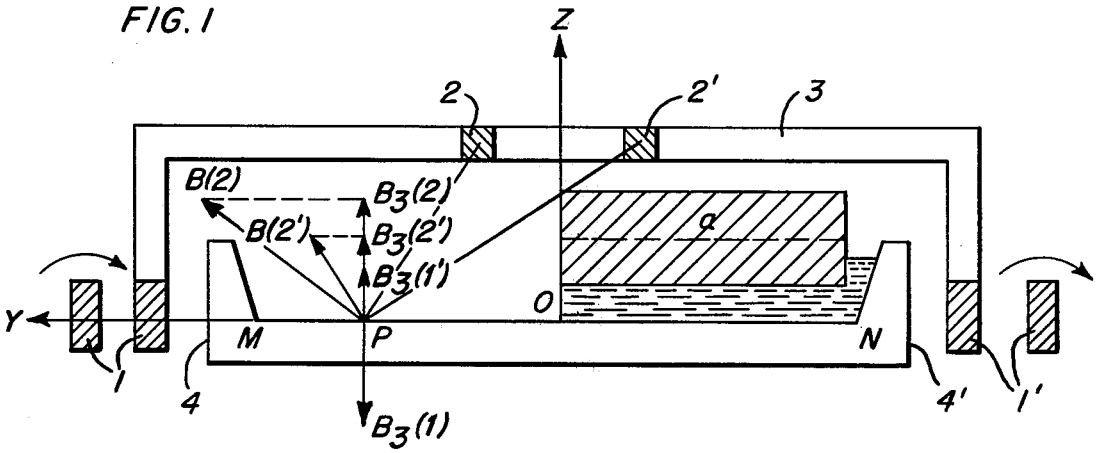

In particular, for the vertical component $B_z$, this discrepancy is generally positive for the points of the cathode situated on the side of the positive y and negative by antisymmetry for those situated on the side of the negative y. This is caused by the fact that the $B_z$ component is the resultant of the elementary fields of the different conductors surrounding the cell, the main ones being (FIG. 1):

the lateral connections 1 between cells situated on the side of the positive y giving a field $B_z$(1) which is always negative, reasoning for the points of the cathode situated on the side of the positive y.

the central risers 2, 2' supplying the anode bus bar 3 giving fields $B_z$(2) and $B_z$(2'), the total of which is always positive.

In the following, the term anode bus bar will be used in a general manner to designate the system of suspension and electrical supply of the anode system without making any particular hypothesis on the structure which can comprise, in particular, a single cross-beam, two electrically separated cross-beams or two cross-beams joined by equipotential connections.

lateral connections (1') between cells situated on the side of the negative y giving a field $B_z$ (1') which is always positive.

Now the vertical field resulting from the lateral connections 1 and 1' which is always negative is greatly attenuated by the screen effect formed by the heads of the 4+4', although this applies less to the field resulting from the central risers 2 and 2' which are always positive.

This results in a positive discrepancy on the side of the positive y in the real value of the $B_z$ field measured in relation to its calculated value.

Similar reasoning for the points located near the center shows that the screen effect weakens because it becomes quite uniform for all the conductors which are a source of $B_z$. Furthermore, the different fields tend to balance out. There will thus be only a slight discrepancy between the measured values and calculated values which also apply to a weak resulting $B_z$ field.

This theory is verified by experimental measurement which allows an arrangement and a distribution of the current circulating in the different conductors supplying the cell to be selected so as to obtain reduced magnetic effects.

The forces known as Laplace forces which develop in the metal are the source of the deformation of the bath/metal interface.

Force along Oy axis: $f(y)=j_zB_x-j_xB_z$

Force along Ox axis: $f(x)=j_yB_z-j_zB_y$ $B_x$, $B_y$ and $B_z$ being the three measured components in the magnetic field B along the axes parallel to Ox, Oy and Oz.

Measured $B_x$=calculated $B_x$+field of magnetization $B_x$

Measured $B_y$=calculated $B_y$+field of magnetization $B_y$

Measured $B_z$=calculated $B_z$+field of magnetization $B_z$ $j_x$, $j_y$ and $j_z$ being the three components of the current density in the metal.

Figure 2:
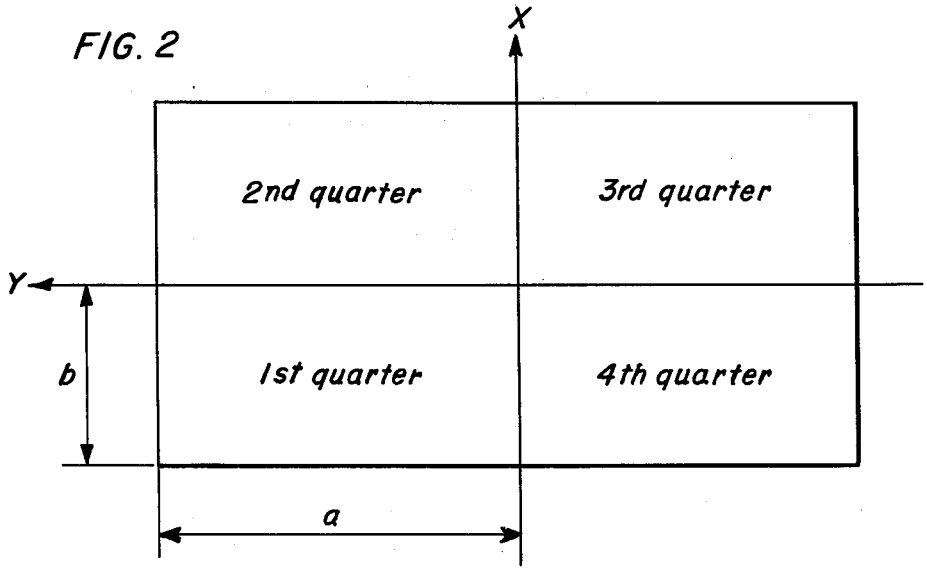
FIG. 2 shows diagrammatically a horizontal section of the cathode of an electrolysis cell divided into four quarters, numbered one to four by convention, this convention being valid for the other figures.

FIG. 2 gives a horizontal section of a transverse cell at the level of the central point of the cathode plane and divided into four quarters by the Ox and Oy axes.

The sum of the forces $f_1(y)$ on a line parallel to Oy of abscisse (x) in the first quarter is $$F_1(y) = \int_{+a}^{0} f_1(y)dy = j_z \int_{+a}^{0} B_x dy - j_x \int_{+a}^{0} B_z dy \quad (1)$$

because on each axis parallel to Oy:

$j_z$ is constant since it is uniform over the entire cell and $j_x$ is constant owing to the usual arrangement of the cathode bars.

Similarly, in the fourth quarter and on the same y axis parallel to Oy $$F_4(y) = \int_{0}^{-a} f_4(y)dy = j_z \int_{0}^{-a} B_x dy - j_x \int_{0}^{-a} B_z dy \quad (2)$$

If $F_1(y)$ is $-F_4(y)$, the forces on each line parallel to Oy will be equal and opposite. For this it is sufficient that:

$$\int_{+a}^{0} B_x dy = -\int_{0}^{-a} B_x dy \quad (3)$$

and $$\int_{-a}^{0} B_z dy = -\int_{0}^{-a} B_z dy \quad (4)$$

These two equations will be verified if the values of $B_x$ and $B_z$ on a y axis are antisymmetrical about the xOz plane. Case of the horizontal field $B_x$: in a transverse cell, the conductors along the y and z axes normally being arranged symmetrically about x O z, the calculated $B_x$ field will be antisymmetrical.

The same applies to the ferro-magnetic masses with respect to x O z and the field of magnetization $B_x$ will be antisymmetrical. This means that the actual measured field $B_x$ will also be antisymmetrical about Ox. Case of the vertical field $B_z$: in a transverse cell, the conductors along the x and y axes normally being arranged symmetrically about x-z, the calculated $B_z$ field will be antisymmetrical.

The same applies to the ferro-magnetic masses with respect to x O z and the field of magnetization $B_z$ will be antisymmetrical. This means that the actual measured field $B_z$ will itself be antisymmetrical about O x.

All things considered on each y:

$$F_1(y) = -F_4(y) \quad (5)$$

and $$\sum_{-b}^{0} F_1(y) \text{ on the first quarter} = -\sum_{-b}^{0} F_4(y) \text{ on the fourth quarter} \quad (6)$$

Now let us examine the longitudinal forces in the second and third quarters. The equations are the same as for the first and fourth quarter and $$\sum_{0}^{+b} F_2(y) \text{ on the second quarter} = -\sum_{0}^{+b} F_3(y) \text{ on the third quater} \quad (7)$$

Equations 6 and 7 show that the bath/metal interface will be symmetrical about x O z in each half of cell delimited by the y O z plane. An extra condition should now be added so that the Laplace forces are equal in each half delimited by the Ox axis, that is to say:

$$\sum_{-b}^{0} F_1(y) = \sum_{0}^{+b} F_2(y) \quad (8)$$

whence it follows that:

$$\sum_{0}^{+b} F_3(y) = \sum_{-b}^{0} F_4(y) \quad (9)$$

Let us write the equations of the Laplace forces for $F_1$ and $F_2$ $$F_1(y) = \int_{+a}^{0} f_1(y)dy = j_z \int_{+a}^{0} B_x dy - j_{1x} \int_{+a}^{0} B_z dy \quad (10)$$

and $$F_2(y) = \int_{+a}^{0} f_2(y)dy = j_z \int_{+a}^{0} B_x dy - j_{2x} \int_{+a}^{0} B_z dy \quad (11)$$

since $j_z$ is constant on two axes arranged symmetrically about Oy owing to the normal arrangement of the cathode rods.

For $j_x$, the currents traversing the cathode rods are equal and in opposite directions for all points arranged symmetrically about Oy.

Therefore: $j_2x=-j_1x$ and equation (11) becomes in the fourth quarter of the cell:

$$F_2(y) = \int_{+a}^{0} f_2(y)dy = j_z \int_{+a}^{0} B_x dy + j_{1x} \int_{+a}^{0} B_z dy \quad (12)$$

Case of the horizontal field $B_x$: in a transverse cell, the conductors parallel to the Oy and Oz axes being arranged symmetrically about the y O z plane, the field Bx will be symmetrical.

Case of the vertical field $B_z$: the first terms of equations (10) and (12) have been equalized. In order to check equation (8), it is sufficient that:

$$-j_{1x} \int_{+a}^{0} B_z dy \text{ (first quarter)} = +j_{1x} \int_{+a}^{0} B_z dy \text{ (second quarter)}$$

that is to say:

$$-\int_{+a}^{0} B_z dy \text{ (first quarter)} = +\int_{+a}^{0} B_z dy \text{ (second quarter)}$$

in other words, if the values of $$\int_{+a}^{0} B_z dy$$

on two axes arranged symmetrically about Oy are antisymmetrical, equation (13) and therefore equation (8) will be verified. Now it is observed that in a transverse view the values of the $$\int_{+a}^{0} B_z dy$$

integrals of the actual field on two axes parallel to Oy and arranged symmetrically are asymmetrical with respect to the value of the integral $$\int_{+a}^{0} B_z dy$$

on the Oy axis.

Condition (13) will therefore be satisfied when:

$$\int_{+a}^{0} B_z dy$$

on the Oy axis of the measured field will be (14) equal to 0.

Figure 3:
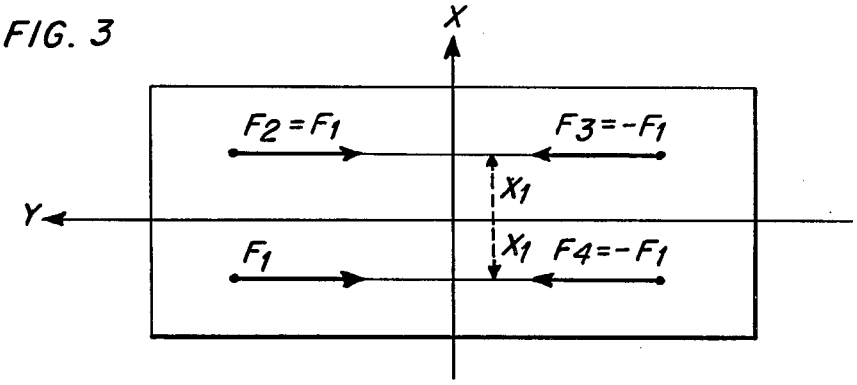
FIG. 3 is a graph of the longitudinal horizontal components, forces known as Laplace forces, developed in the metal by the magnetic fields.

To conclude, if condition (14) is satisfied, the following is obtained on two axes parallel to Oy and arranged symmetrically about Oy and at a distance $x_1$, FIG. 3:

$$F_1 = -F_4;\ F_1 = F_2;\ F_2 = -F_3 \text{ and } F_3 = F_4$$

that is to say $$\begin{aligned} F_2 &= F_1 \\ F_3 &= -F_1 \\ F_4 &= -F_1 \end{aligned} \quad (15)$$

and for the sum of the longitudinal forces per quarter cell, similarly:

$$\sum_{0}^{+b} F_2 = \sum_{-b}^{0} F_1,\ \sum_{0}^{+b} F_3 = -\sum_{-b}^{0} F_1 \text{ and } \sum_{-b}^{0} F_4 = -\sum_{-b}^{0} F_1$$

This equality of the longitudinal forces which are opposed two by two has the result that:

The bath/metal interface will be dome-shaped and symmetrical about x O z;

The bend of the dome will be minimal and in practice it is observed that when condition (14) is satisfied, the bath/metal interface is practically flat and only slight uneveness, which is difficult to measure as it is less than 1 centimeter, remains on the periphery of the anode system; and There is no more movement of the metal discernible by the variation in the resistance of the cell.

Figure 4:
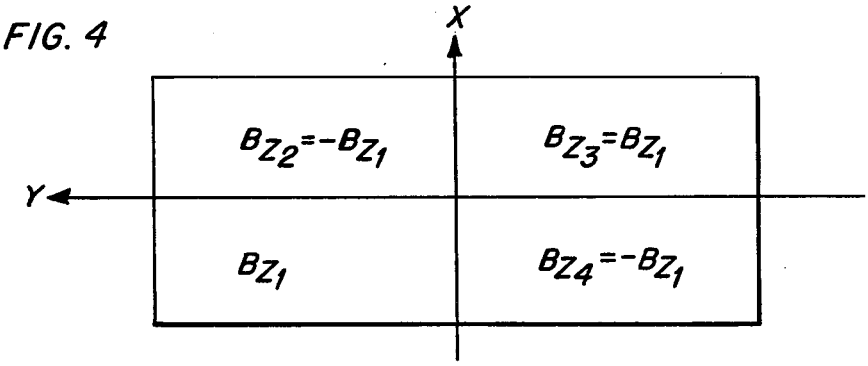
FIG. 4 is a graph of the average $B_z$ fields per quarter cell.

In fact, equations (4) and (13) have as a result, calling $B_z1$ average in the first quarter cell, $$B_{z1} \text{ average (first quarter cell)} = \frac{1}{s} \sum_{-b}^{0} \int_{+a}^{0} B_z dy$$

s being the surface of a quarter cell $B_z$ average first quarter $= +B_{z1}$ $B_z$ average second quarter $= -B_{z1}$ $B_z$ average third quarter $= +B_{z1}$ $B_z$ average fourth quarter $= -B_{z1}$ Now, it is known that the movements of metal depend upon the average value of $B_z$ per quarter cell. They become negligible when these values are equal and have opposite signs two by two as shown in FIG. 4.

Furthermore, this equality corresponds to a minimum value per quarter cell of the average $B_z$.

STATEMENT OF THE INVENTION

It has been seen that the technological progress in measuring apparatus has allowed the demonstration of the differential action caused by the ferro-magnetic masses on the elementary fields of the different conductors depending upon their position with respect to the said ferro-magnetic masses.

It has thus been possible to determine experimentally this action which has been called "field of magnetization" and which constitutes a correction in the calculation which is not negligible.

It has already been shown that the condition $$\int_{+a}^{0} B_z dy = 0$$

of the actual field measured on the Oy axis ended at average values for $B_z$ per quarter cell which are equal in absolute values but have opposite signs taken two by two and this resulted in a practically flat bath/metal interface, absence of movement in the cathode metal.

This stability allows the operating conditions of the cells to be optimized and very high yields of energy to be obtained while fully utilizing the computer's fineness of regulation.

In order to obtain the condition $$\int_{+a}^{0} B_z dy = 0$$

and the similar condition $$\int_{0}^{-a} B_z dy = 0$$

of the actual field $B_z$ measured on the Oy axis, it is possible to act upon the position of the conductors for connection between cells and the intensity which passes through them.

Figure 5:
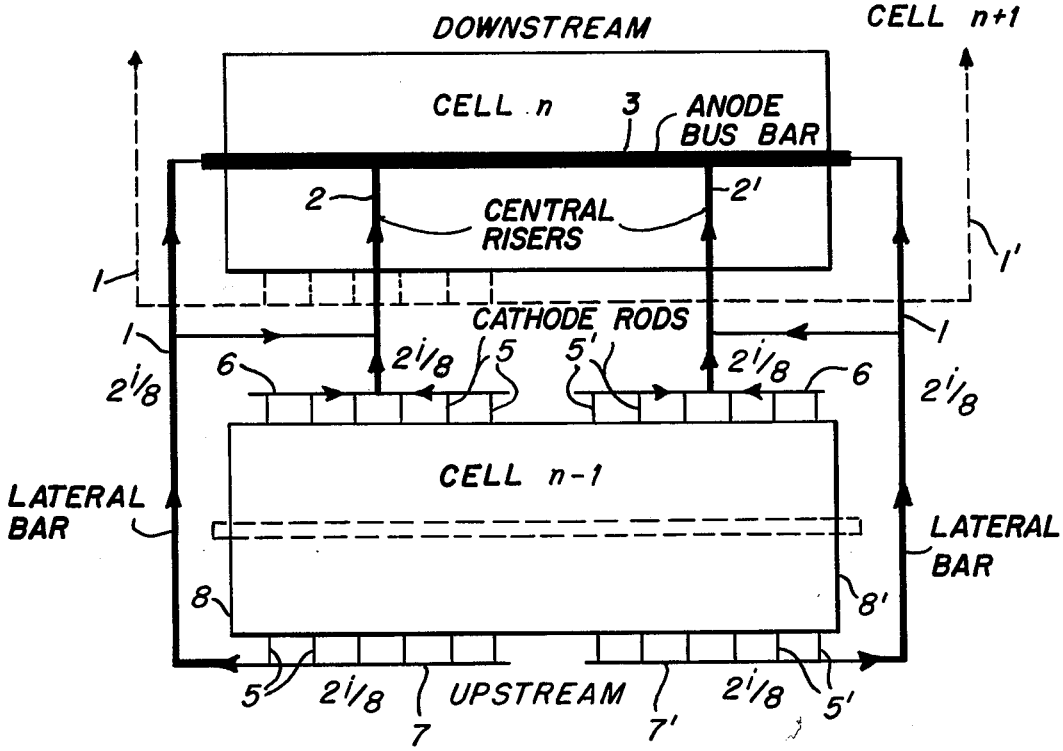
FIG. 5 is a general diagram of the conductors for connection between cells, according to the invention.

FIG. 5 gives diagrammatically the arrangement of the assembly of conductors providing a connection between an upstream cell (n−1) and a downstream cell (n), shown with two head risers and two central risers supplying the anode bus bar 3 of the downstream cell. It is quite obvious that the number of central risers, which is two here, is not limited. Conversely, in the case of cells with a less elevated intensity, for example of 70,000 to 100,000 amperes, or if the device according to the invention is to be adapted to existing cells where the space available is relatively limited, it is possible to provide a single central riser situated on the Ox axis of the series.

The cathode rods 5, 5' of the upstream cell (n−1) are connected at each of their ends to negative bars 6, 6', 7, 7', the number of which per quarter cell generally depends upon the size of the cell. For the sake of simplification, only one has been shown per quarter cell in FIG. 5.

The total intensity leaving the negative bar or bars per quarter cell is $$\frac{2\,\dot{I}}{8}.$$

The upstream negative bars 7, 7' of the upstream cell (n−1) pass round upstream angles 8, 8' of the upstream cell and become attached to the lateral bars 1, 1' situated along the small edges of the upstream cell to conduct the current to the anode bus bar 3 of the downstream cell (n).

The downstream negative bars 6, 6' of the upstream cell supply the anode bus bar 3 of the downstream cell by means of central risers 2, 2'.

It has been observed that, depending upon the dimensions of the cell, the size of the ferro-magnetic masses constituted mainly by the box, the superstructures, the cathode rods, the building and the position of the rods for connection between cells, the intensity "i" supplying each end of the anode bus bar had to be between $\dot{I}/8$ and 2 $\dot{I}/8$ for the weights of ferro-magnetic masses normally used in the construction of cells.

Figure 6:
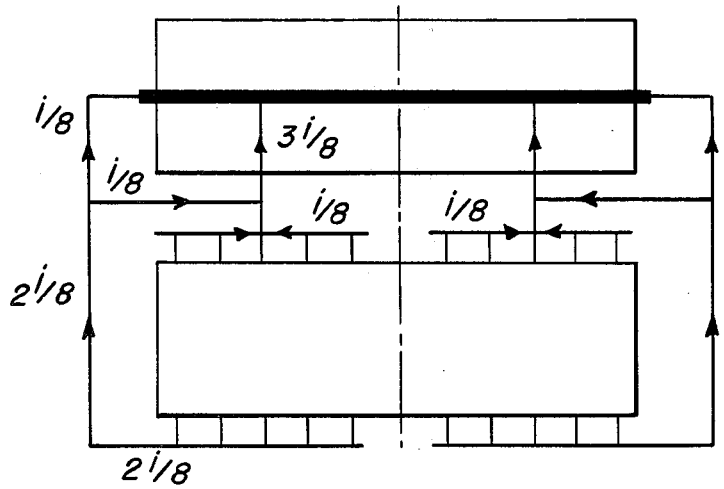
FIGS. 6, 7 and 8 show different variations of the supply from the anode bus bar according to the invention with variation in the fraction of the intensity supplying the ends and the intermediate connectors of the anode bus bar. In order to simplify the drawing, the supply has been shown only on the left-half, the right-half being symmetrical.
Figure 7:
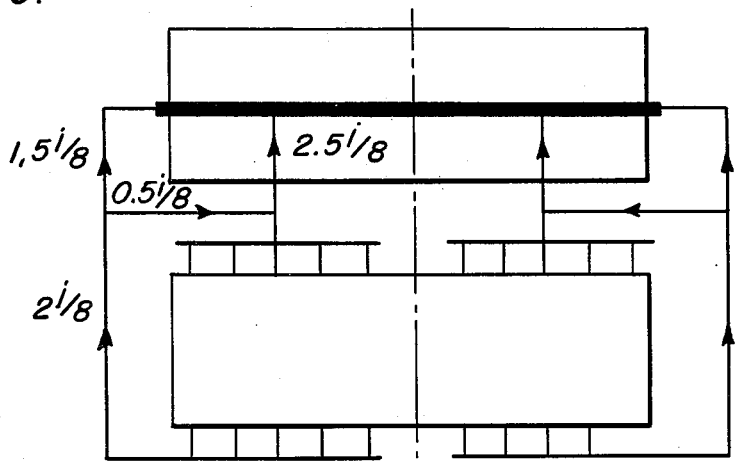
Figure 8:
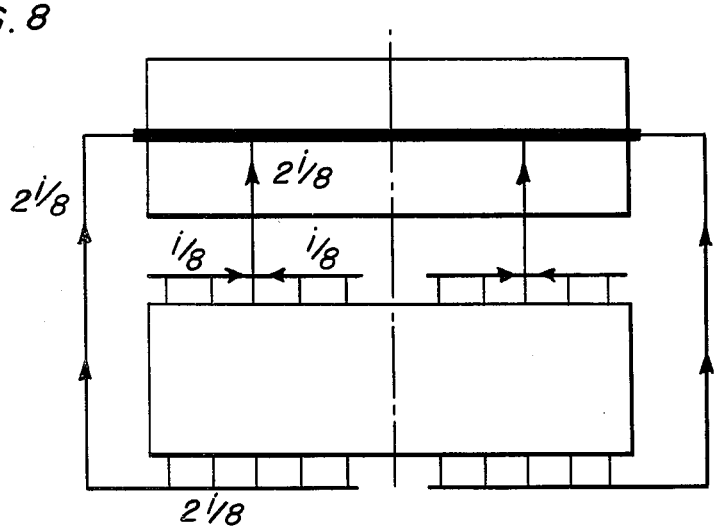

FIGS. 6, 7 and 8 give the diagram of the conductors for the cases where the intensity "i" supplying each spider head is $\dot{I}/8$; 1.5 times $\dot{I}/8$ and two times $\dot{I}/8$ respectively.

It is advantageous to select for the connecting conductors a position in the horizontal plane which is as close as possible to the heads of the shell but which is compatible with the constraints posed by operation and electrical safety.

Figure 9:
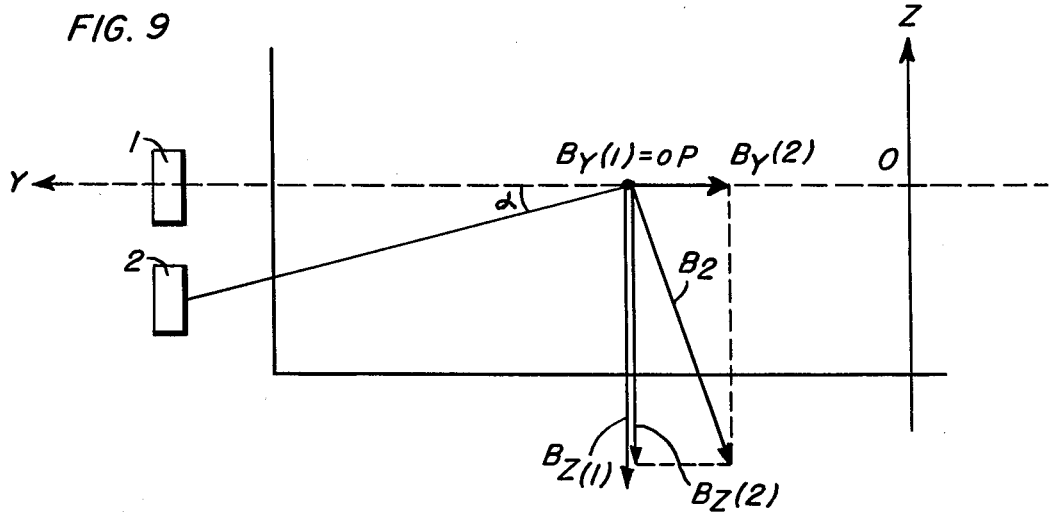
FIG. 9 is a comparative graph of the value of the fields $B_z$ and $B_y$ of the lateral bus bars as a function of their position with respect to the plane of the metal.

In the vertical direction, these conductors are usually placed in a plane quite near to that of the metal in order:

not to lengthen the circuits for a relatively low gain in the $B_z$ component which there is with the cosine of the angle $\alpha$ (FIG. 9).

not needlessly to introduce additional $B_x$ and $B_y$ components which appear very rapidly when the distance from the plane of the metal is increased since these additional components vary with the sine of the angle $\alpha$.

In industrial practice, it is necessary for economic reasons to take the shortest possible routing for the conductors for connection between cells, but this choice does not restrict the field of application of the invention.

"i" is first determined in the following manner:

based on a routing retained for the connecting conductors, the curve of the theoretical values of $B_z$ is determined by calculation on the Oy axis. This curve is a function of "i".

the values of the $B_z$ field of magnetization on the Oy axis is known from experimentation. This curve is also a function of "i".

by writing that measured $B_z$ equals theoretical $B_z$ plus magnetization $B_z$, the curve of the actual $B_z$ is determined on the Oy axis, a function of "i".

the actual $$\int_{+a}^{0} B_z dy$$

integral on Oy is calculated for different values of "i".

The value $i_o$ corresponding to the following condition is found:

Actual $$\int_{+a}^{0} B_z dy$$

on the Oy axis equals 0.

The value $i_o$ is comprised between $\dot{I}/8$ and 2 ($\dot{I}/8$).

EXAMPLE

A 175,000 A cell designed according to the claims of U.S. Pat. No. 4,049,528, gave the following results:

average intensity: 175,500 amp.

Faraday yield: 91.1% average voltage: 4.07 volts.

Which corresponds to a specific consumption of 13,330 kWh/5.

An arrangement of the conductors forming the subject of the present invention with two central risers, the supply of each end of the spider being equal to 1.3 (I/8), was used on the same cell functioning with the same operating parameters, the same quality of alumina, the same acidity of the bath, etc. The following results were then obtained:

average intensity: 177,000 amp.

Faraday yield: 92.8% average voltage: 4.02 volts.

which corresponds to a specific consumption of 12,940 kWh/t, thus constituting one of the best performances obtained hitherto with cells operating with such a high amperage.

We claim:

1. A device for supplying electric current between very high intensity electrolysis cells connected in series, for the purpose of reducing magnetic distrubances, wherein each cell is oriented transversely to the axis of the series, and each cell includes an anode bus bar, a plurality of cathode output rods, and at least one central riser for coupling cathode output rods from an upstream cell to an anode bus bar of a downstream cell, comprising means for supplying electrical current through the two ends of said anode bus bar and through said at least one central riser, and wherein the fraction of the total current intensity ($\dot{I}$) supplying each end of the anode bus bar is between $\dot{I}/8$ and $2\dot{I}/8$.

2. A device as claimed in claim 1 and further including a lateral conductor for supplying current to the ends of said anode bus bar, a branch line from said lateral conductor, said central riser being supplied with current both from said branch line and from said cathode output rods of an upstream cell, said central riser supplying current to said downstream anode bus bar.

* * * * *